United States Patent [19]

Schultz et al.

[11] 4,146,855

[45] Mar. 27, 1979

[54] LOW PROFILE MULTI-POLE CIRCUIT BREAKER HAVING MULTIPLE TOGGLE SPRINGS

[75] Inventors: John T. Schultz, Cedar Rapids; James W. Dickens, Marion, both of Iowa

[73] Assignee: Square D Company, Park Ridge, Ill.

[21] Appl. No.: 830,506

[22] Filed: Sep. 6, 1977

[51] Int. Cl.[2] ..... H01H 75/00; H01H 77/00; H01H 83/00

[52] U.S. Cl. ..... 335/8; 335/16; 335/35; 335/191

[58] Field of Search ..... 335/8, 9, 10, 35, 191, 335/16

[56] References Cited

U.S. PATENT DOCUMENTS

| | | | |
|---|---|---|---|
| 2,844,689 | 7/1958 | Middendorf | 335/35 |
| 3,384,845 | 5/1968 | Johnson et al. | 335/16 |
| 3,646,488 | 2/1972 | Iida et al. | 335/16 |
| 3,774,129 | 11/1973 | Sugiyama | 335/191 |

*Primary Examiner*—Harold Broome

*Attorney, Agent, or Firm*—Norton Lesser; Richard T. Guttman

[57] ABSTRACT

A multi-pole circuit breaker includes a wide toggle shaft which spans all of the poles of the breaker and which is electrically neutral. The lower links of the toggle mechanism are made of phenolic or other insulating material which thus electrically insulates the wide toggle shaft spanning all of the poles of the breaker and makes the toggle shaft electrically neutral. A plurality of short toggle springs may therefore be connected between the wide toggle shaft and a handle arm of corresponding width. The plurality of short toggle springs provide as much tripping energy as the longer single or double toggle springs of prior art circuit breakers in which the springs are clustered together in alignment with one pole of the breaker to which they are electrically connected and whose polarity the toggle springs in such prior art breakers accordingly take. Thus by providing a tripping mechanism which can utilize a plurality of short toggle springs in place of one or two long ones, a lower profile circuit breaker is possible. In addition, the movable contact blade of each pole of the multi-pole breaker of this invention is biased independently toward a contact closed position. Each contact blade is pivotally mounted to the lower end of its corresponding insulated lower toggle link, with the end of the contact blade opposite the contact end being biased in one direction by a cantilever spring to urge the contact end in the opposite direction to the contact closed position. The biasing force is selected to permit the movable contact of each contact pair to separate by virtue of electrodynamic and thermodynamic "blow-apart" forces occurring during a severe short circuit in the phase in which such pole is connected.

22 Claims, 9 Drawing Figures

LOW PROFILE MULTI-POLE CIRCUIT BREAKER HAVING MULTIPLE TOGGLE SPRINGS

BACKGROUND OF THE INVENTION

This invention relates to the field of multi-pole circuit breakers having a tripping mechanism of the toggle spring type.

Typically such mechanism include upper and lower toggle links pivotally connected on a toggle shaft with a spring connected between the toggle shaft and the cross arm of an operator. The operator is pivotally mounted to move the end of the spring connected thereto between a first position, in which the upper and lower links are flexed and the movable contact arm connected to the lower link is separated from the stationary contact, and a second position, in which the upper and lower links are extended and slightly over center with the movable contact arm connected to the lower link moved into contact with the stationary contact of the circuit breaker. The upper link is pivotally connected to a trip lever which is pivotally mounted to move between a latched position and an unlatched position. When in the latched position, the upper toggle link is pivotally anchored at its upper end on the trip lever to remain in the same location when the operator is moved to both its first and second positions, i.e. the contact separated position and contact closed position. The upper end of the upper toggle link remains anchored to the latched trip lever while the operator carries the spring and toggle shaft (which pivotally connects the upper toggle link at the other end to the lower toggle link) from the contact open position wherein the toggle links are flexed to the contact closed position carrying the toggle shaft to a slightly over center position wherein the toggle links become substantially extended to move the contact arm connected to the lower link into the contact closed position. When the trip lever is unlatched, the bias of the toggle springs on the toggle shaft is in a direction toward the end of the upper link which is connected to the trip lever, and laterally away from the latch member in a direction toward the operator cross arm to which the other end of the spring is connected, causes the trip lever to move away from the latch member and toward the cross arm of the operator which it contacts and which limits further movement of the trip lever. Such movement of the trip lever carriers the end of the upper toggle link anchored thereto forward beyond the pivot point of the toggle shaft to which the other end of the upper toggle link and one end of the lower toggle link are pivotally connected, enabling the bias of the spring on the toggle shaft to carry it toward the operator arm to which the other end of the spring is connected until the spring is substantially de-tensioned and the toggle mechanism collapsed with the toggle links flexed and the movable contact arm carried to the contact separated position.

In typical prior art circuit breakers of this type, the upper and lower toggle links are of electrically conductive metal, as is the movable contact blade connected to the lower toggle link. The toggle mechanism is thus electrically conductive in prior art circuit breakers and takes the polarity of the pole in which it is connected. The other poles of the circuit breaker must be insulated from the toggle mechanism or a phase to phase fault, or short circuit, would result. Such insulation is typically accomplished by a narrow toggle mechanism which can be centered over a single pole of the breaker, and then using a wide crossbar of phenolic or other insulating material in which to mount the movable contact blades of the other poles of the breaker.

Since the toggle shaft pivotally connecting the upper and lower toggle links of such prior art circuit breakers must be relatively short to center over only one pole of the breaker, there is space to connect only one spring in the usual breaker of this type between the toggle shaft and the crossarm of the operator. The single spring must be relatively long in order to provide the desired tripping energy to rapidly trip the breaker on occurrence of a fault current. Such circuit breakers therefore have a relatively high profile, or a depth of relatively large dimension.

It is desired to make circuit breakers of the type described above of lower profile, having a depth of smaller dimension. The present invention accomplishes such result by providing insulated lower links between the toggle shaft and contact blades whereby the toggle shaft is electrically neutral. It may, therefore extend across the entire width of a multi-pole circuit breaker and a plurality of relatively shorter toggle springs may be connected between the toggle shaft and the spaced apart crossarm of the operator. A plurality of the shorter toggle springs can be selected to equal the energy of a single longer toggle spring of a prior art breaker, and in this manner a lower profile breaker is achieved, having a depth of relatively smaller dimension.

Since each contact arm of the circuit breaker, in accordance with this invention, is connected to the toggle shaft through its own insulated lower link, it is possible for each contact blade to include the additional feature of being independently separable without separating the contacts of the other poles of the breaker. The independently separable contacts of the present invention include a movable contact mounted on a movable contact blade which is pivotally mounted to the insulated lower link of the toggle mechanism. The end of the contact blade opposite the contact end is biased by a cantilever spring in one direction which forces the contact end of the contact blade in the opposite direction to the contact closed position. Bias is applied to the contact blade in a manner such that each blade may independently blow apart as a result of electrodynamic and thermodynamic forces to a fully open position with no increase in bias force. This is not possible in prior art breakers in which individual contact blades are suspended from a common crossbar.

SUMMARY OF THE INVENTION

It is an object of the invention to provide a low profile circuit breaker having a depth of relatively small dimension in which a plurality of relatively short toggle springs are utilized across the width of the breaker and spanning all poles of the circuit breaker.

It is an object of the invention to provide a low profile multi-pole circuit breaker having a toggle trip mechanism in which the contacts of each pole are insulated from the toggle mechanism.

It is an object of the invention to provide a low profile multi-pole circuit breaker having a toggle trip mechanism including lower links and upper links pivotally connected on a toggle shaft, in which the lower links connected to the contact blades are electrically insulated, and in which the toggle shaft is wide enough to span all poles of the multi-pole circuit breaker.

It is an object of the invention to provide a low profile multi-pole circuit breaker in which the contacts of each pole are independently connected to the toggle shaft of such a breaker through respective lower links of electrically insulating material and in which such contacts are independently separable to a fully open position with no increase in contact bias force by electrodynamic and thermodynamic forces occuring as a result of a severe short circuit in the phase of such circuit in which such pole of the circuit breaker is connected.

DESCRIPTION OF PREFERRED EMBODIMENT

Figure 1:
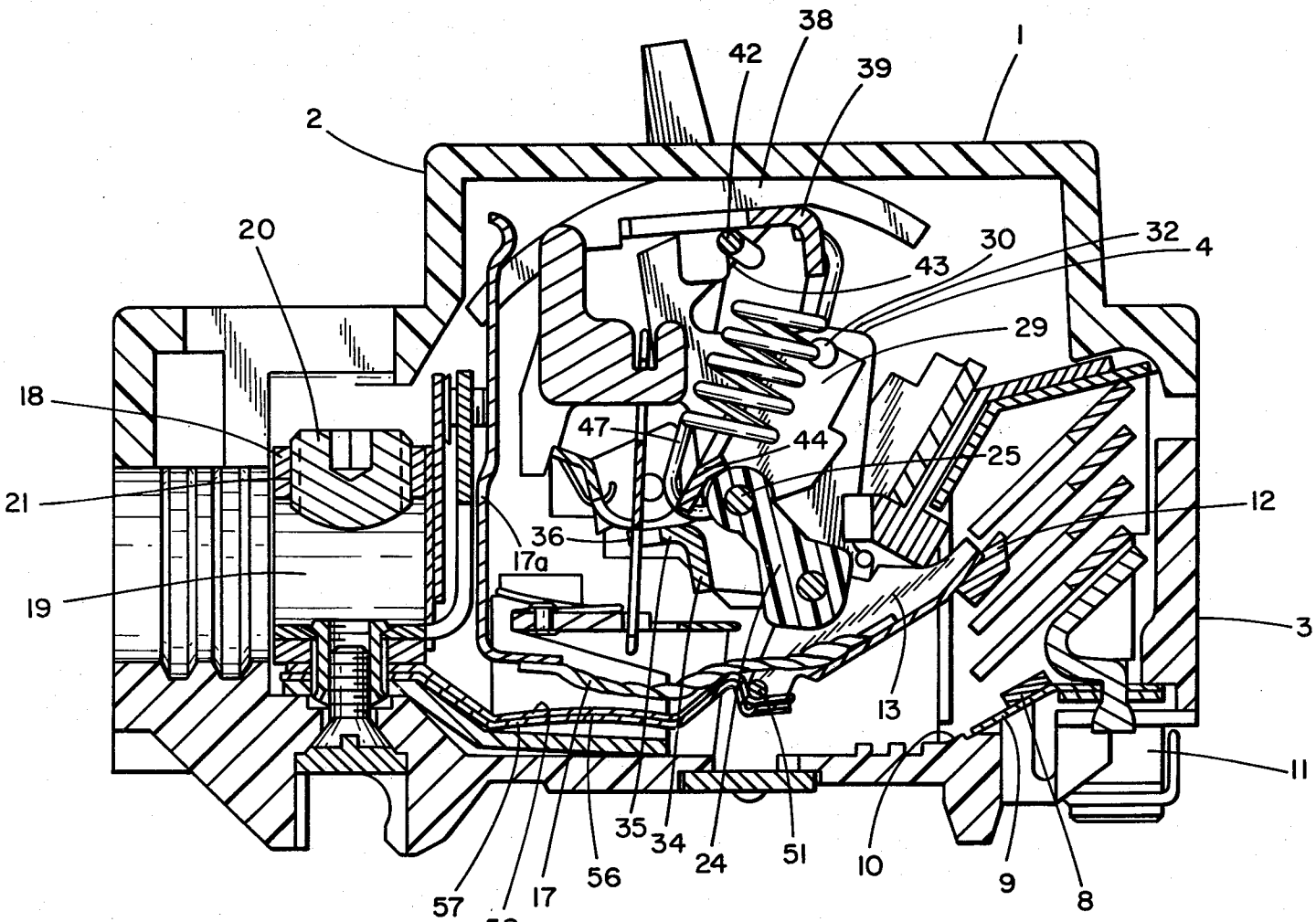
FIG. 1 is an elevation view of a circuit breaker in accordance with this invention having one side broken away and partially in section showing the tripping mechanism in latched but contact open position.
Figure 2:
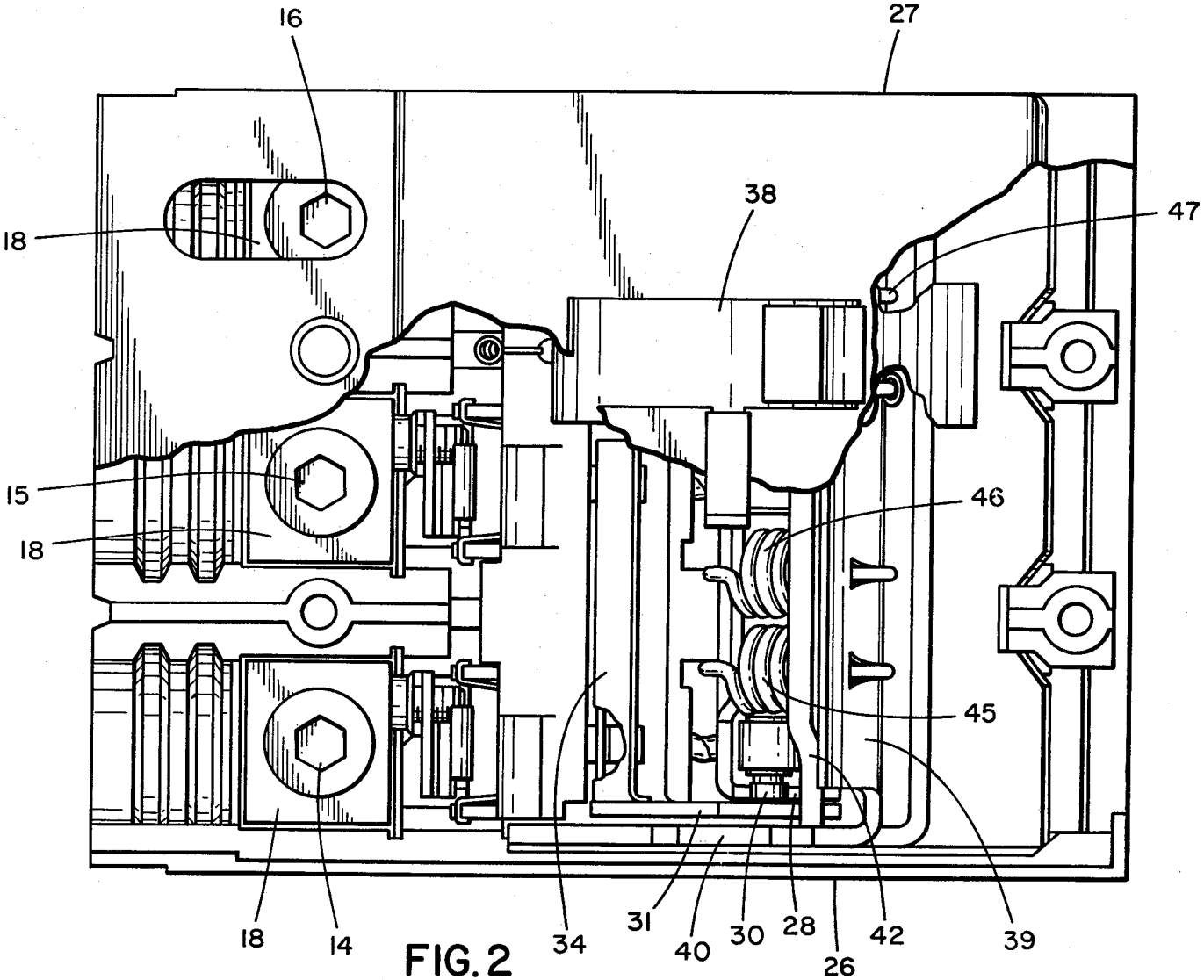
FIG. 2 is a plan view of the circuit breaker in FIG. 3 having the top cover partially broken away.

A multi-pole circuit breaker 1 includes a cover 2 and a base 3 in which a tripping and resetting mechanism 4 is mounted to open and close three pairs of contacts 5, 6 and 7. Each pair of contacts is connected in a separate phase of a three-phase circuit.

The stationary contacts 8 of each contact pair are mounted respectively on a conductive metal strip 9, one end of which rests on the floor 10 of the base and the other end of the conductive metal strip connects to respective jaw members 11, which plug on to respective bus bars of a load center in which the circuit breaker is mounted for use.

The movable contacts 12 of each contact pair are mounted at one end of respective movable contact blades 13. The opposite end of each movable contact blade is conductively connected to respective ones of the three load-side terminals 14, 15 and 16, through flexible conductors 17 and bimetal 17*a*. These terminals each include a lug 18 having a channel 19 therethrough to receive the respective conductors of a load to which the circuit breaker may be connected. Each terminal 14, 15 and 16 includes a binding screw 20 threadedly mounted in the internally threaded bore 21, to clamp respective conductor wires of the load in the channels 19.

The movable contact blades 13 are pivotally connected at an intermediate point to one end of respective lower toggle links 22 of the tripping and resetting mechanism 4. The lower toggle links 22 in accordance with this invention are made of electrically insulating material such as phenolic. The tripping and resetting mechanism 4 is thus electrically insulated from the current carrying portions of the circuit breaker.

The lower toggle links 22, 23 and 24 are pivotally connected at their opposite ends to a toggle shaft 25 which extends across the base 3 between side walls 26 and 27 and thus spans each pole of the multi-pole circuit breaker including each pair of contacts 5, 6 and 7 connected in separate phases of a three phase circuit.

The toggle shaft 25 extends between upper toggle links 28 and 29 at the lower end thereof. The upper toggle link 28 is spaced inwardly from side wall 26 of the base 3, and upper toggle link 29 is spaced inwardly from side wall 27 of the base 3. The upper ends of upper toggle links 28 and 29 are connected respectively to pivot posts 30 projecting inwardly from trip levers 31 and 32 of trip lever assembly 33. Trip levers 31 and 32 are spaced apart substantially the width of the base 3, with trip lever 31 being inwardly from side wall 26 and trip lever 32 being inwardly from side wall 27. The trip levers 31 and 32 are integrally joined by a cross member 34 which extends across the base 3, and on which two latch projections 35 are formed, extending rearwardly to catch beneath corresponding latch members 36 when in the latched position. The trip levers 31 and 32 are pivotally mounted in the breaker, to rotate between a latched and unlatched position.

A circuit breaker operator 38 includes a U-shaped frame, having a crossbar 39 with legs 40 and 41 depending from each opposite end thereof. The lower ends of legs 40 and 41 are pivotally mounted in the breaker with leg 40 being inwardly of and adjacent to side wall 26 of the base 3 and leg 41 being inwardly of and adjacent to the opposite side wall 27. The operator 38 includes a stop rod 42 which extends thereacross between the depending legs 40 and 41. The stop rod 42 bears against corresponding cam surfaces 43 on trip levers 31 and 32 when the operator 38 is moved in the latching direction to latch the trip levers in the latched position.

The toggle shaft 25 and upper toggle links 28 and 29 are part of an integral upper toggle link assembly which also includes an anchor bar 44 as an integral component thereof. The anchor bar 44 extends across the cavity of base 3 between the upper toggle links 28 and 29, spaced apart from the toggle shaft 25 a short distance and parallel thereto. First ends of toggle springs 45, 46 and 47 are attached to anchor bar 44, and the other or second ends of such springs are attached to the crossbar 39 of the operator 38.

It will be noted that a plurality of toggle springs may be so connected across the span between upper toggle links 28 and 29 on each side of the base 3 since the integral upper toggle link assembly, of which anchor bar 44 is a part, is electrically insulated from the conductive portions of the multi-pole circuit breaker including the three parts of contacts 5, 6 and 7, by the lower toggle links 22, 23 and 24 which are made of electric insulating material such as phenolic. Thus, each toggle spring 45, 46 and 47 may be relatively shorter than if only one toggle spring were used as in prior art multi-pole breakers wherein the toggle mechanism was not electrically insulated. In such prior art breakers the toggle spring had to be centered over the pole in which it was electrically connected to avoid a short circuit or a phase to phase fault current. The plurality of relatively shorter toggle springs of this invention are able to achieve the same biasing force as one longer spring of prior art multi-pole breakers. When shorter toggle springs can be used, the distance between the operator crossbar 39 and the anchor bar 44 of the upper toggle link assembly may be reduced. It is thus possible to make a multi-pole circuit breaker of less depth, or lower profile, which has biasing force equivalent to prior art multi-pole breakers of greater depth, or higher profile.

Since the toggle shaft 25 extends across all poles of a multi-pole circuit breaker, each movable contact blade 13 may be suspended directly from such shaft 25 by a separate lower toggle link 22, 23 or 24. With this type of individual pole suspension, it is possible to provide individual "blow-open" protection for each pair of contacts independently of the other contact pairs in the other poles of the circuit breaker. Upon occurrence of a severe short circuit in any phase, the electrodynamic and thermodynamic forces inherent in current flow arcing phenomena will cause the contacts in such phase to blow-open independently before the electromagnetic assembly is able to trip the breaker. Thus, such quick blow-open response will reduce the $I^2t$ let-through on such a short circuit.

The mechanism which enables each contact pair to blow-open independently of the other contact pairs, includes the lower toggle links 22, 23 and 24 which are pivotally connected at one end to the toggle shaft 25 and at the opposite ends they are pivotally connected to respective ones of movable contact blades 13 by pivot pins 48 located at an intermediate point of the movable contact blades 13 between their respective contact ends 49 and their opposite ends 50. The opposite ends 50 of each movable contact blade 13 include a guide pin 51 secured thereto. The guide pin 51 of each movable contact blade is received in a slot 52 in a respective guideway 53 mounted in the circuit breaker for the movable contact blade of each pole of the breaker. The guide pin 51 is movable in slot 52 between a contact closed position (in which case the guide pin 51 is at an intermediate point 54(a) of the slot 52 as shown in the drawings) and a contact open position (in which case the guide pin 51 moves to the lower end 54(b) of slot 52 during the blow-open mode enabling the contact end 49 to move upward and separate from the stationary contact 8 by pivoting on the pivot pin 48).

The end 50 of movable contact blade 13 is biased toward the upper end 54(c) of slot 52 by a cantilever spring assembly 56, the movable contact blade 13 thus being normally biased to the contact closed position for purposes of the blow-open mode of operation. The cantilever spring assembly includes two spring leaves 57 and 58, one nested over the other, to increase the biasing force while maintaining a greater degree of flexibility than if a single spring leaf of thickness equal to that of both leaves 57 and 58 were utilized.

The spring assembly 56 is a low gradient spring, in the sense that it has a relatively large deflection to biasing force ratio. In other words, it deflects a relatively large amount between its working or biased position and its substantially unbiased or free position. The position of the breaker shown in FIG. 1 corresponds to the position of the tripping mechanism shown in FIG. 5 (latched with contacts open), and in which the guide pin 51 is at the upper end of the guideway slot 52. The position of the breaker shown in FIG. 3 corresponds to the position of the tripping mechanism shown in FIG. 6 (latched with contacts closed), and in which the guide pin 51 is at an intermediate position within the guideway slot 52. The position of the breaker shown in FIG. 8 corresponds to the position of the tripping mechanism shown in FIG. 9 (latched with contacts open in the blow-open mode).

Figure 3:
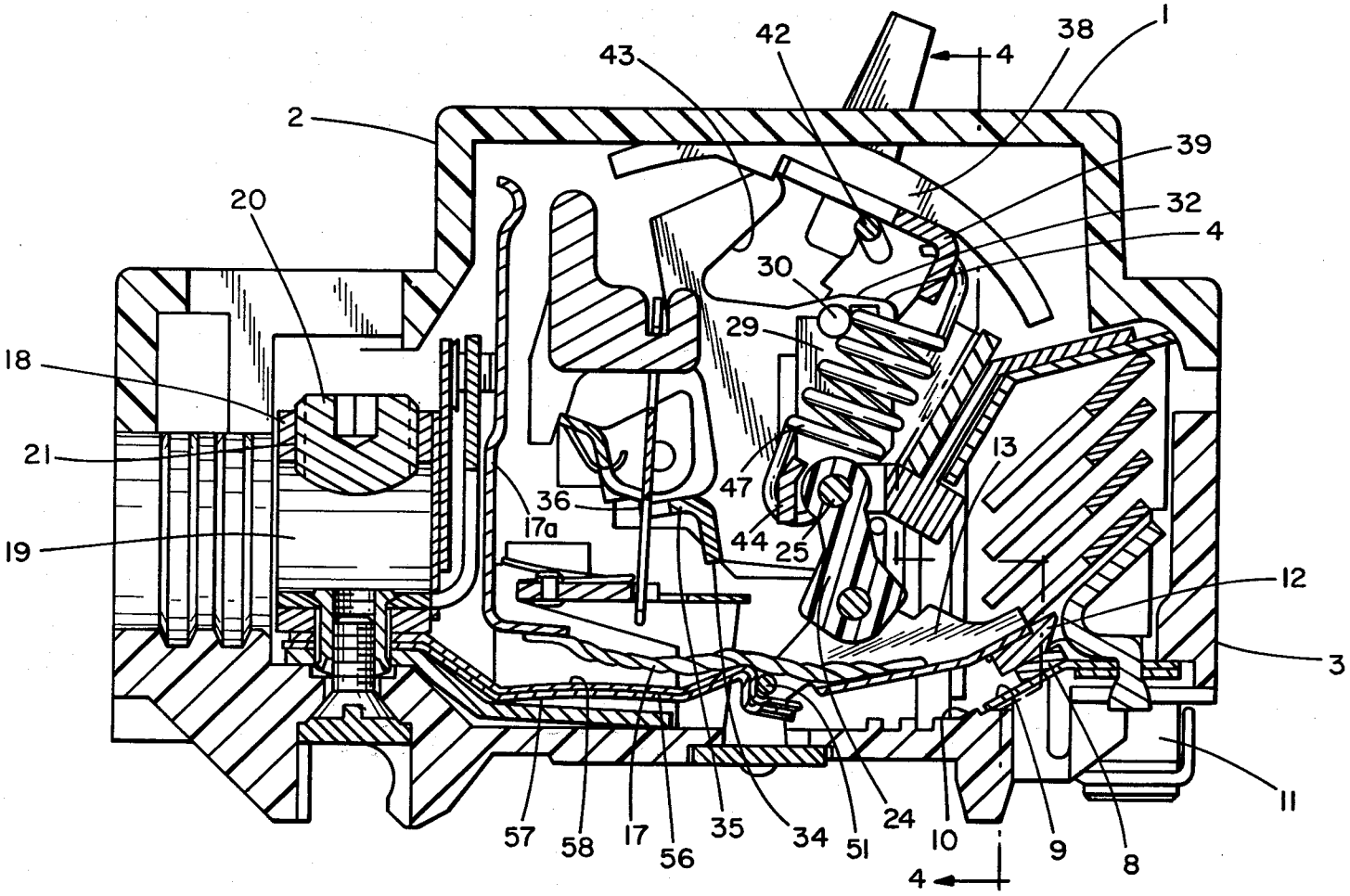
FIG. 3 is a side elevation of the circuit breaker in FIG. 1 showing the tripping mechanism in contact closed position.
Figure 4:
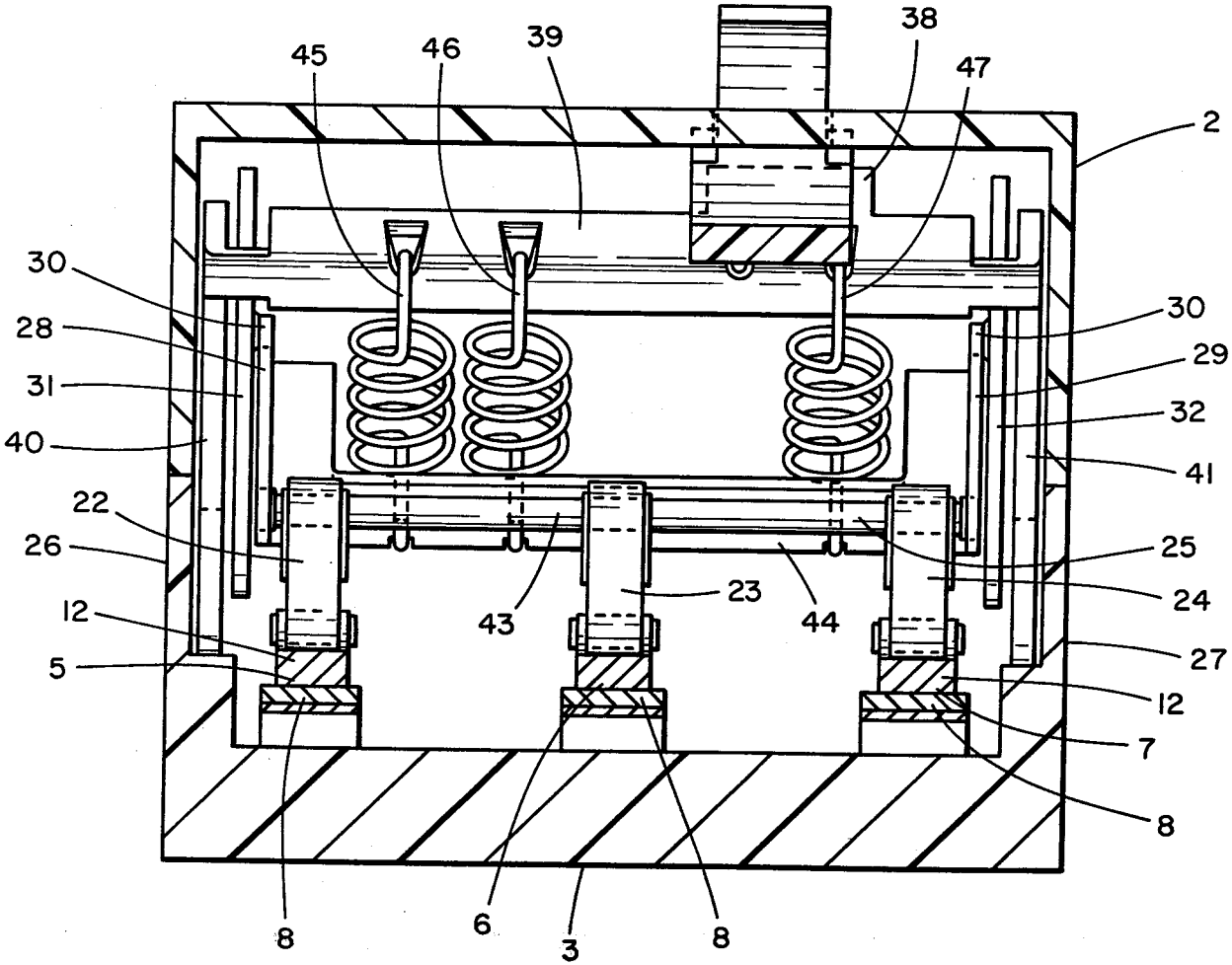
FIG. 4 is a section view taken on line 4-4 of FIG. 3.
Figure 5:
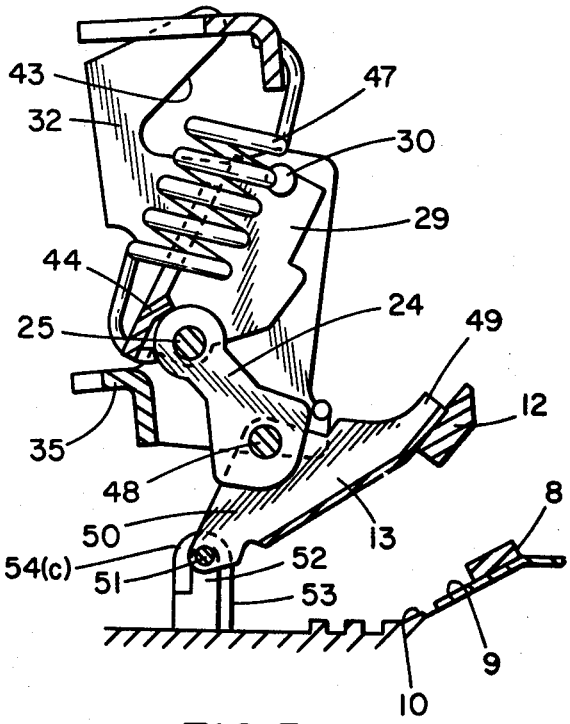
FIG. 5 is a side elevation of the tripping mechanism in accordance with this invention shown in latched position but with contacts open.
Figure 6:
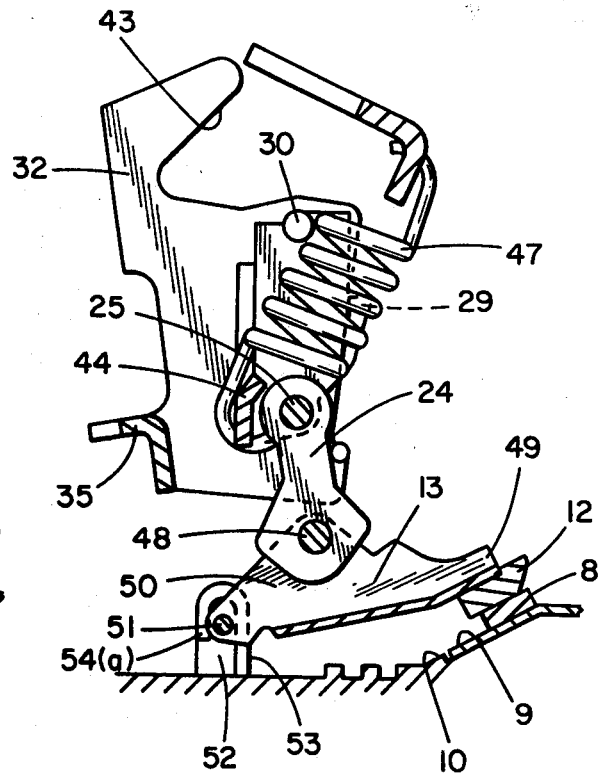
FIG. 6 is a side elevation view of the tripping mechanism of FIG. 5 shown in latched position with the contacts closed.
Figure 7:
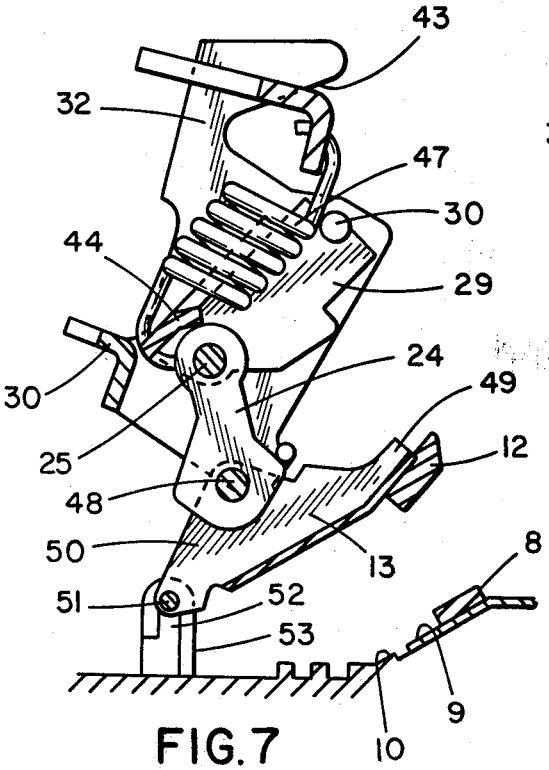
FIG. 7 is a side elevation view of the tripping mechanism of FIG. 5 shown in tripped position.
Figure 9:
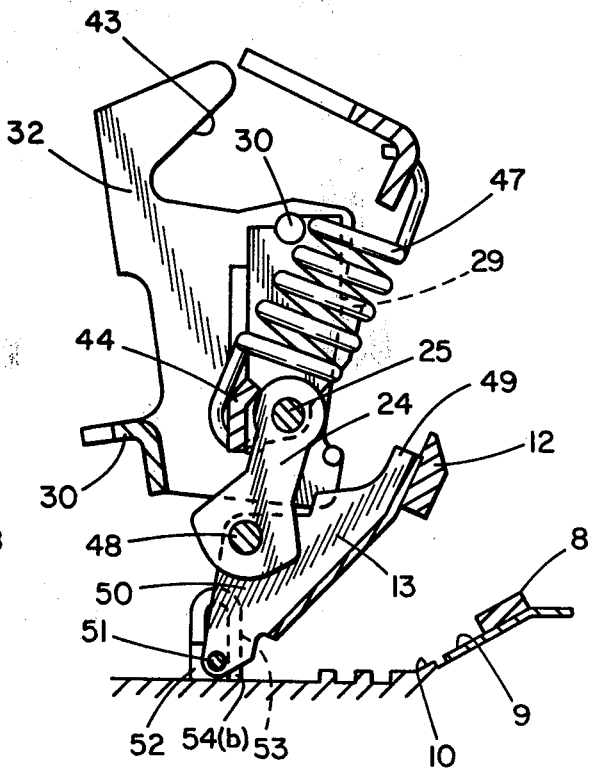
FIG. 9 is a side elevation view of the tripping mechanism of FIG. 5 shown in latched position, with the upper and lower links in the normal contact closed position but with the contact shown separated in the blow-open mode.
Figure 8:
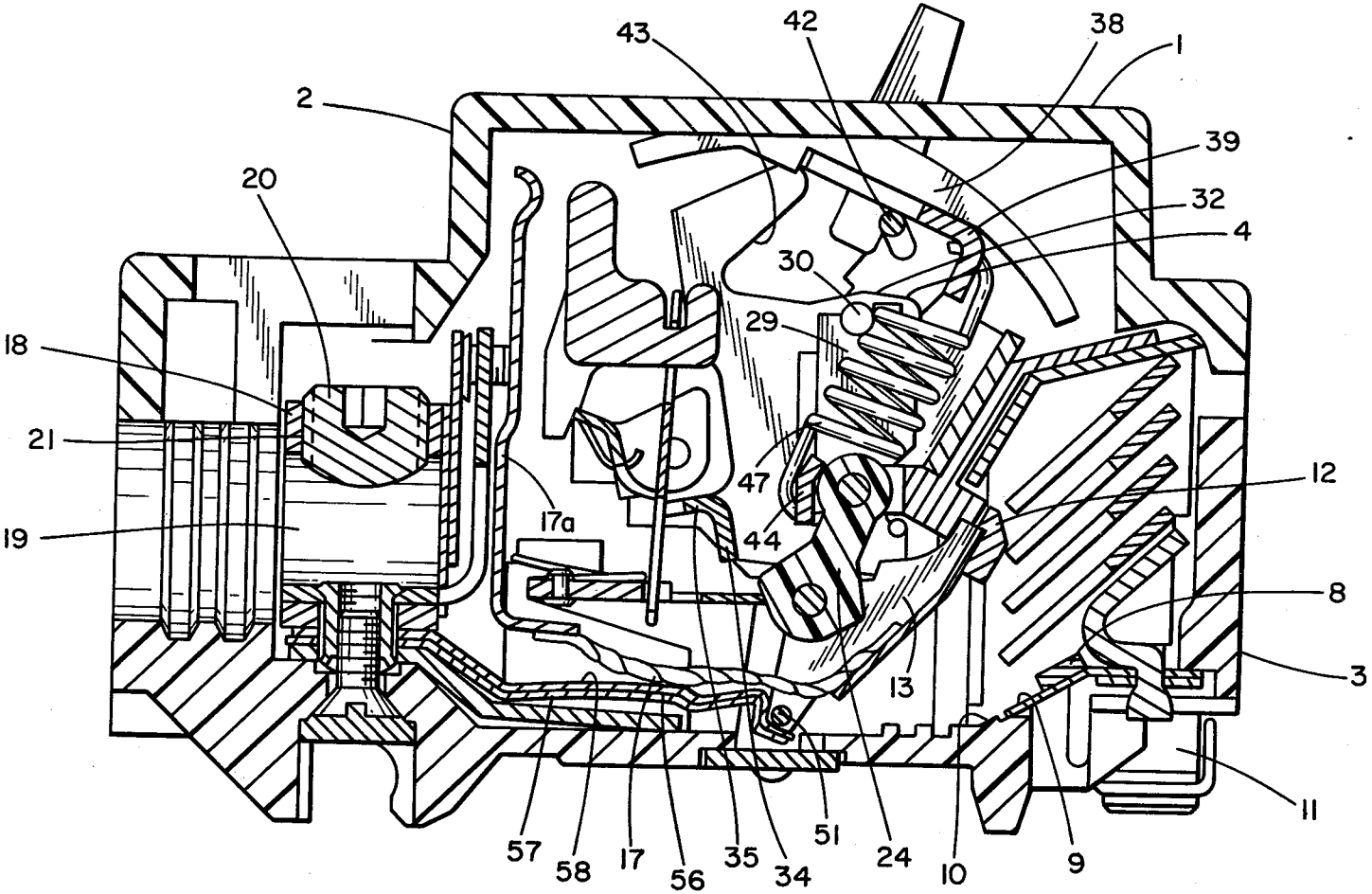
FIG. 8 is a side elevation view of the circuit breaker of FIG. 1 shown in latched position, with the operator in contact closed position but with the contacts of one pole shown separated in the blow-open mode.

The guideway slot 52 is not shown in FIGS. 1, 3 and 8 to avoid crowding of parts in the drawing, and it is instead shown in corresponding FIGS. 5, 6 and 9 depicting the tripping mechanism alone.

The low gradient spring assembly 56 is biased against the guide pin at the end of movable contact blade 13 opposite the contact end. Since the movable contact blade 13 pivots about the pivot pin 48, it functions as a lever with pivot pin 48 serving as the fulcrum, spring assembly 56 biased against guide pin 51 serving as the power, and the contact end of blade 13 comprising the weight. In the latched, contact closed position (FIGS. 3, 6), the line of force of spring assembly 56 against guide pin 51 is spaced apart from the axis of the fulcrum or pivot pin 48 a relatively great distance giving the spring assembly 56 a relatively great mechanical advantage in biasing the opposite contact end and movable contact 12 toward the contact closed position.

In the blow-open mode, on occurrence of a severe short circuit which causes the movable contact 12 to separate from stationary contact 8, the fulcrum or pivot pin 48 at the lower end of lower toggle link 24 is carried in a direction towards the line of force of the spring assembly 56 against guide pin 51 by virtue of lower link 24 being itself pivotally connected at its opposite end to the toggle shaft 25 which remains stationary during the blow-open mode of operation and until the tripping mechanism is unlatched. The guide pin 51 is positioned on movable contact blade 13 at such point relative to the fulcrum or pivot pin 48 that when the contact end of the contact blade 13 is in its fully open position, the line of force of the spring assembly 56 against guide pin 51 is substantially in line with the fulcrum or pivot pin 48. As the fulcrum or pivot pin 48 is carried in the direction toward the line of force, reducing the distance between the power point and the fulcrum point of the lever, the mechanical advantage exerted by the spring assembly 56 decreases until it becomes negligible when the line of force comes in line with the fulcrum. Stated in other words, the described structure and relationship of spring assembly 56 to the movable contact blade 13 and its lever parts (guide pin 51 being the powered end, pivot pin 48 being the fulcrum, and the end carrying movable contact 12 being the weight) provides a negative torque gradient during the blow-open mode of operation. This has the advantage that as the contact 12 begins to blow open and separate from stationary contact 8 the opposition force actually decreases rather than increases. Since the opposition force progressively decreases as the contacts begin to blow open, they respond easily and rapidly to completely separate on occurrence of a severe short circuit, thus significantly limiting the $I^2t$ let-through on such a short circuit.

The contact suspension and toggle mechanism of this invention also provides increased contact scrubbing and rocking action upon opening and closing of the movable contact blades 13. Increased toggle spring energy is possible because as described previously the electrically insulated lower toggle links 22, 23 and 24 make it possible to connect a plurality of toggle springs 45, 46 and 47 across all poles of the circuit breaker from one side to the other. This increased toggle spring energy which biases the contact end of the movable contact blade 13 toward the contact closed position provides greater contact overtravel. Such greater contact overtravel, combined with the movable pivot pin 48 around which the movable contact blade 13 pivots as described above when moved between the contact open and contact closed positions, and with the guide pin 51 biased towards the contact closed position at the end of contact blade 31 opposite its contact end, causes the scrubbing and rocking action of the contacts. When the movable contact blade 13 is moved from the contact open position (FIGS. 1, 5) to the contact closed position (FIGS. 3, 6), the movable contact 12 is positioned on the movable contact blade 13 at such point that its forward end first touches the rearward portion of stationary contact 8 at a slight angle. The continuing pressure of the toggle springs moving the upper links (28, 29) and lower links (22, 23, 24) from a flexed to a substantially extended position when operator 28 is moved to the contact closed position, continues to force the movable contact 12 against the stationary contact 8 causing it to slide forward and provide a scrubbing action. At the moment of first impact of the movable contact 12 against the rearward portion of stationary contact 8, the guide pin 51 at the opposite end of the movable contact blade 13 is still at the upper end of the guideway slot 52. As the toggle springs apply continuing downward pressure on the movable contact blade 13 after movable contact 12 has contacted stationary contact 8, the guide pin 51 at the opposite end of the blade 13 begins to move downward in the guideway slot 52, which extends in a substantially vertical direction as shown in FIGS. 5, 6, 7 and 8 or in a direction which intersects the plane in which the surface of stationary contact 8 lies. Such downward movement of guide 51 in the vertically extending slot 52 requires the opposite contact carrying end of blade 13 to move forwardly, or outwardly away from the guideway slot 52 as continuing downward pressure is applied on blade 13 at pivot pin 48 by the links moving from flexed to extended position under influence of the toggle springs. As the contact end of blade 13 is moved forwardly, or outwardly, the movable contact 12 is pushed across the surface of stationary contact 8 from the point of initial contact at its rearward portion to eventually come to rest in substantially full facing relationship therewith. Such downward and forward movement of movable contact 12 against stationary contact 8 provides effective scrubbing action to clean the contacts thus reducing contact resistance.

The end of blade 13 opposite the contact end being biased by spring assembly 56 toward the contact closed position, but having freedom to move up and down within the confines of the guideway slot 52 against such bias, provides a cushion to absorb some of the impact when movable contact 12 contacts stationary contact 8 upon closing. The blade 13 tends to rock on pivot pin 48 and transmit a portion of the impact forces to the end of blade 13 opposite the contact end which absorbs such forces against the bias of spring assembly 56 through guide pin 51. Such rocking and cushioning effect tends to reduce contact bounce and thus prolong contact life.

In operation, when a severe short circuit occurs in any one of the phases, the electrodynamic and thermodynamic forces of such short circuit current flow will exert pressure on the contacts and the movable contact blade 13 urging them toward a contact separated position. Such force in a severe short circuit is sufficient to overcome the bias of cantilever spring assembly 56, allowing the end 50 of movable contact blade 13 to move downwardly toward the lower end 55 of slot 52 in the guideway 53 which at the same time allows the contact end 49 of the movable contact blade 13 to move upwardly to a contact open position as the blade 13 pivots on the pivot pin 48.

The short circuit in one phase which causes the contacts in that phase to blow-open will also trigger the electromagnetic trip mechanism causing all poles of the breaker to open. However, the electromagnetic trip does not respond as quickly as the independent blow-open mechanism. Consequently, by providing such independent blow-open mechanism for each pole of the circuit breaker, the $I^2t$ (or let-through, or short circuit current against time) is reduced.

After the fault has been cleared, the cantilever spring assembly 56 biases the guide pin 51 toward the upper end 54 of slot 52 in guideway 53, thus causing the movable contact blade to pivot on pivot pin 48 and to urge the contact end 49 towards the contact closed position when the toggle mechanism is latched and the operator 38 is moved to the contact closed position. When in the contact closed position, the guide pin 51 is located within the slot 52 at an intermediate point, inwardly from both ends of the slot, and the guide pin 51 is under continuing bias from spring assembly 56 toward the contact closed position.

We claim:

1. A multi-pole circuit breaker, including a tripping mechanism, each pole of said multi-pole circuit breaker including a pair of openable contacts connected in series between a line side terminal means and a load side terminal means and operatively connected to said tripping mechanism, said pairs of contacts being openable by said tripping mechanism on occurrence of a fault current in any one phase of a multi-phase circuit in which said multi-pole circuit breaker is connected, said tripping mechanism including spring means, and electrical insulating means to insulate said spring means electrically from said pair of contacts, said tripping mechanism including a trip lever assembly movable between a latched and an unlatched position, a toggle assembly comprising a toggle shaft, first link means pivotally connected between said toggle shaft and said trip lever assembly, and second link means pivotally connected between said toggle shaft and said contacts, said second link means being of electrically insulating material and thus comprising said electrical insulating means.

2. A multi-pole circuit breaker as set forth in claim 1, wherein the poles of said multi-pole breaker are in side-by-side parallel relationship, said toggle shaft extends across a plurality of said poles, an operator assembly engageable with said trip lever assembly to move it from an unlatched position to a latched position and operable to move said contacts between a contact open and contact closed position after said trip lever assembly has been latched, said operator assembly including a cross bar extending across a plurality of poles of said circuit breaker at a location spaced apart from and substantially parallel to said toggle shaft, said spring means comprising a plurality of toggle springs connected between said toggle shaft and said cross bar of said operator assembly.

3. A multi-pole circuit breaker as set forth in claim 2, wherein one of said plurality of toggle springs is spaced apart from another one of said plurality of toggle springs by a distance greater than the width of one pole of said multi-pole breaker.

4. A multi-pole circuit breaker as set forth in claim 2, wherein each of the side-by-side poles of said circuit breaker occupies a lateral space across the width of said circuit breaker of substantially equal dimension, and wherein one of said plurality of toggle springs is spaced apart from another one of said plurality of toggle springs by a distance greater than the width of said lateral space occupied by any one of said poles of said breaker.

5. A multi-pole circuit breaker as set forth in claim 1, wherein each pole of said breaker includes a movable contact blade, one of said contacts of said pair of contacts of each pole being mounted on said movable contact blades of its respective pole, said second link means including for each pole an electrically insulated link member pivotally connected between said movable contact blade for each respective pole and said toggle shaft.

6. A multi-pole circuit breaker as set forth in claim 5, wherein at least one of said movable contact blades includes blow-open means to open said pair of contacts independently of said tripping mechanism by virtue of electrodynamic and thermodynamic forces resulting from occurrence of a severe short circuit in one phase of a multi-phase circuit in which said multi-pole circuit breaker is connected.

7. A multi-pole circuit breaker as set forth in claim 6, wherein said blow-open means includes pivot means connecting said electrically insulated link member to said movable contact blade at an intermediate portion thereof, a first end region of said movable contact blade having said contact mounted thereon extending in one direction from said pivot means, a second end region of said movable contact blade extending in the opposite direction from said pivot means, said second end region being movable between a first position which pivots with first end region on said pivot means to a contact closed position and a second position which pivots said first end region to a contact open position, said second end region being normally biased toward said first position.

8. A multi-pole circuit breaker as set forth in claim 7, including guide means to guide said second end of said movable contact blade in its movement said first and second positions.

9. A multi-pole circuit breaker as set forth in claim 8, wherein said guide means includes a support structure, a guideway in said support structure, a guide pin on said second end region of said movable contact blade, said guide pin being received in said guideway for movement therein as said movable contact blade is pivoted between said contact closed and contact open positions.

10. A multi-pole circuit breaker as set forth in claim 7, including spring means to bias said second end region of said movable contact blade toward said first position.

11. A multi-pole circuit breaker as set forth in claim 10, wherein said spring means includes a cantilever spring.

12. A multi-pole circuit breaker as set forth in claim 10, wherein said spring means includes a cantilever spring assembly, said cantilever spring assembly including a first spring leaf and a second spring leaf overlaid thereon.

13. A circuit breaker for interrupting an electrical circuit, including a tripping mechanism, a pair of openable contacts connected in series between a line side terminal means and a load side terminal means and operatively connected to said tripping mechanism, said pairs of contacts being openable by said tripping mechanism on occurrence of a fault current above a preselected magnitude in said electrical circuit, said tripping mechanism including first spring means to open said contacts on occurrence of said fault current, and blow-open means to open said pair of contacts independently of said tripping mechanism by virtue of electrodynamic and thermodynamic forces resulting from a severe short circuit greater than the magnitude of said fault current in said electrical circuit, said tripping mechanism including toggle means comprising pivotally connected upper and lower toggle links movable between a flexed and an extended position, said first spring means including a toggle spring biasing said upper and lower links toward said flexed position, a movable contact carrier, one of said openable contacts being mounted on said movable contact carrier at a first end region thereof, said blow-open means including carrier pivot means connecting said lower toggle link to said movable contact carrier at an intermediate portion thereof, a second end region of said movable contact carrier extending from said pivot means in a direction opposite from said first end region of said carrier, said second end region being movable between a first position which pivots said first end region on said pivot means to a contact closed position and a second position which pivots said first end region to a contact open position, said second end region being normally biased toward said first position.

14. A circuit breaker as set forth in claim 13, including guide means to guide said second end of said movable contact carrier in its movement between said first and second positions.

15. A circuit breaker as set forth in claim 14, wherein said guide means includes a support structure, an elongated recess in said support structure, a guide pin on said second end region of said movable contact carrier, said guide pin being received in said elongated recess for movement therein as said movable contact carrier is pivoted between said contact closed and contact open positions.

16. A circuit breaker as set forth in claim 15, including second spring means to bias said second end region of said movable contact carrier toward said first position.

17. A circuit breaker as set forth in claim 16, wherein said second spring means exerts force on said second end region along a line of force in a first direction, said line of force extending along a line which is spaced apart a first distance from the axis of said carrier pivot means when said carrier is in said first position, said carrier pivot means being movable towards said line of force as said contact on said movable contact carrier moves from said contact closed to a contact open position, said second spring means thereby providing a negative torque gradient wherein its biasing force decreases as the said contact moves from said contact closed to the contact open position in response to a severe short circuit sufficient to render said blow-open means operable.

18. A circuit breaker as set forth in claim 17, wherein said carrier pivot means is movable toward said line of force until the axis of said carrier pivot means is substantially in line with said line of force, at which time said second end region of said movable contact carrier is substantially in said second position wherein said contact mounted on said first end of said carrier is separated from the other contact of said pair.

19. A circuit breaker as set forth in claim 18, wherein said second spring means includes a low gradient spring deflectable over a relatively large distance between its biased or working position and its substantially unbiased or released position, said low gradient spring thus being able to provide continuing bias on said second end of said movable contact carrier to bias said contacts at said first end thereof in said closed position as said contacts erode from continued use.

20. A circuit breaker as set forth in claim 15, wherein said elongated recess extends in a first direction, said other of said openable contacts being stationary and positioned in said circuit breaker in alignment with said one contact mounted on said movable contact carrier, the surface of said stationary contact lying in a plane which intersects said first direction in which said elongated recess extends, said guide pin and said contact mounted on said movable contact carrier being spaced apart on said carrier along a first imaginary straight line extending between said guide pin and said contact, said guide pin being at substantially one end region of said elongated recess when said movable contact carrier is in said contact open position and when it moves toward said contact closed position until the point of initial impact of said contact mounted on said carrier with said stationary contact, said first imaginary straight line between said guide pin and said contact forming an acute angle with said elongated recess at the moment of said initial impact, said guide pin being movable from said one end region of said elongated recess toward an intermediate position inwardly thereof as said contacts are urged to their fully closed position, said first imaginary straight line forming a second angle with said elongated recess which is less acute than said first angle when said guide pin is moved to said intermediate position, the contact carrying end of said movable contact carrier and the contact thereon thereby being moved outwardly and away from said elongated recess, said contact on said movable contact carrier being thus forced to move across the surface of said stationary contact after initial impact as it is also being forced inwardly against said stationary contact, such action on closing of said contacts serving to scrub said contacts clean to reduce contact resistance.

21. A multi-pole circuit breaker comprising:

a housing;

a plurality of spaced apart line terminals carried by said housing, a plurality of spaced apart load terminals carried by said housing with each load terminal individually corresponding to a respective one of said line terminals, a plurality of parallel elongate blades each having opposite ends with each blade carrying a blade contact adjacent one end, a stationary contact for each blade contact with each stationary contact and blade contact individually corresponding to a respective line terminal and a respective load terminal and adapted to interconnect a respective line terminal with a corresponding load terminal through a respective blade in response to the engagement of a blade contact with a respective stationary contact, insulating means individual to each blade pivotally supporting a respective blade between opposite ends of each blade for pivoting movement about a common axis, an operating assembly means carried by said housing including means common to each blade pivotally supporting each insulating means and operable for moving each insulating means and respective blade simultaneously to engage each blade contact with a respective stationary contact to interconnect each line terminal with a respective load terminal;

fault current means controlling said operating assembly means to pivot said insulating means and move said blades simultaneously for disengaging each blade contact from a respective stationary contact in response to a current of greater than a predetermined magnitude passing between one of said line terminals and a respective one of said load terminals, a low gradient spring individual to each blade carried by said housing and engaged with a respective blade adjacent the end opposite the respective blade contact to provide a bias force to the respective blade for pivoting the respective blade about said common axis in a direction for engaging the respective blade contact with respective stationary contact, said bias force less than the blow-apart force generated by a magnetic field resulting from short circuit current substantially greater than said predetermined magnitude passing through the respective stationary contact, blade contact and blade whereby the respective blade pivots about said axis solely against said bias force for disengaging the respective stationary contact and respective blade contact independently of the control of said operating assembly means by said fault current means, and means enabling relative movement between each blade and the respective low gradient spring independently of said operating assembly for decreasing the bias force provided to the respective blade by said low gradient spring in response to said blow-apart force.

22. The circuit breaker claimed in claim 21 in which said means enabling relative movement between said gradient spring and a respective blade enables the respective blade to move relative said low gradient spring in accordance with the position of the respective stationary contact and the position of the respective insulating means pivotally supporting the respective blade in response to the operation of said operating assembly to engage each blade with a respective stationary blade.

* * * * *

UNITED STATES PATENT AND TRADEMARK OFFICE

CERTIFICATE OF CORRECTION

PATENT NO. : 4,146,855

DATED : March 27, 1979

INVENTOR(S) : John T. Schultz and James W. Dickens

It is certified that error appears in the above-identified patent and that said Letters Patent are hereby corrected as shown below:

Column 2, Lines 47 and 48, " to a fully open position with no increase in bias force should be --underlined--;
Column 4, line 61, "parts" should read --pairs--;
Column 7, line 10, "31" should be --13--;
Column 9, line 46, insert "between" after --movement--;

Signed and Sealed this

*Seventh* Day of *August 1979*

[SEAL]

*Attest:*

*Attesting Officer*

LUTRELLE F. PARKER

*Acting Commissioner of Patents and Trademarks*